United States Patent [19]

Kentosh

[11] 4,396,046

[45] Aug. 2, 1983

[54] BUOY-TO-YOKE COUPLING SYSTEM

[75] Inventor: James M. Kentosh, Northridge, Calif.

[73] Assignee: Amtel, Inc., Providence, R.I.

[21] Appl. No.: 294,381

[22] Filed: Aug. 19, 1981

[51] Int. Cl.[3] ..... B65B 3/04; B63B 21/00

[52] U.S. Cl. ..... 141/387; 114/230; 441/5

[58] Field of Search ..... 114/230; 141/279, 284, 141/387, 388; 137/237, 615; 441/3, 4, 5

[56] References Cited

U.S. PATENT DOCUMENTS

| | | | |
|---|---|---|---|
| 4,010,500 | 3/1977 | Reid, Jr. | 141/387 X |
| 4,176,615 | 12/1979 | Reid et al. | 441/5 X |
| 4,290,158 | 9/1981 | Kuntz | 441/3 |

*Primary Examiner*—Frederick R. Schmidt

*Attorney, Agent, or Firm*—Freilich, Hornbaker, Wasserman, Rosen & Fernandez

[57] ABSTRACT

A mooring and fluid transfer system of the type which utilizes a yoke pivotally connected at its opposite ends to a ship and to a buoy, which enables the use of hard piping along the fluid conduit which couples the buoy to the ship. A cross arm whose middle is rotatably mounted about a vertical axis on top of the buoy and whose opposite ends connect to the arms of the yoke, has a cutout between its middle and ends. The fluid conduit includes a fluid swivel joint for accommodating pivotal movement of the yoke, which lies in the cutout so the axis of the fluid joint is coincident with the horizontal axis of pivoting of the yoke on the yoke connector.

7 Claims, 4 Drawing Figures

FIG. 3
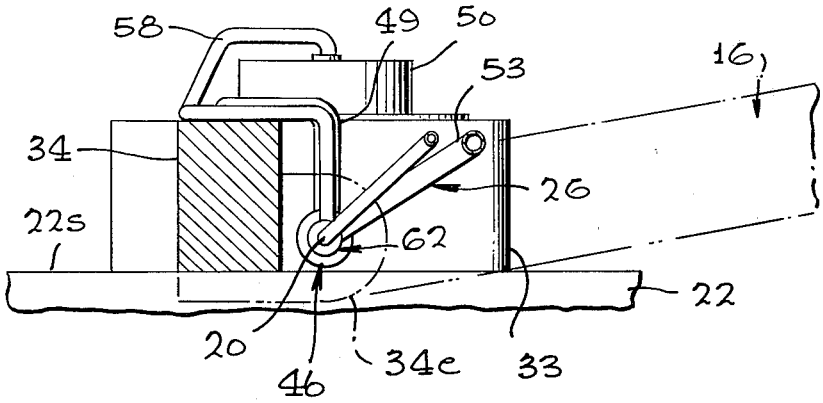
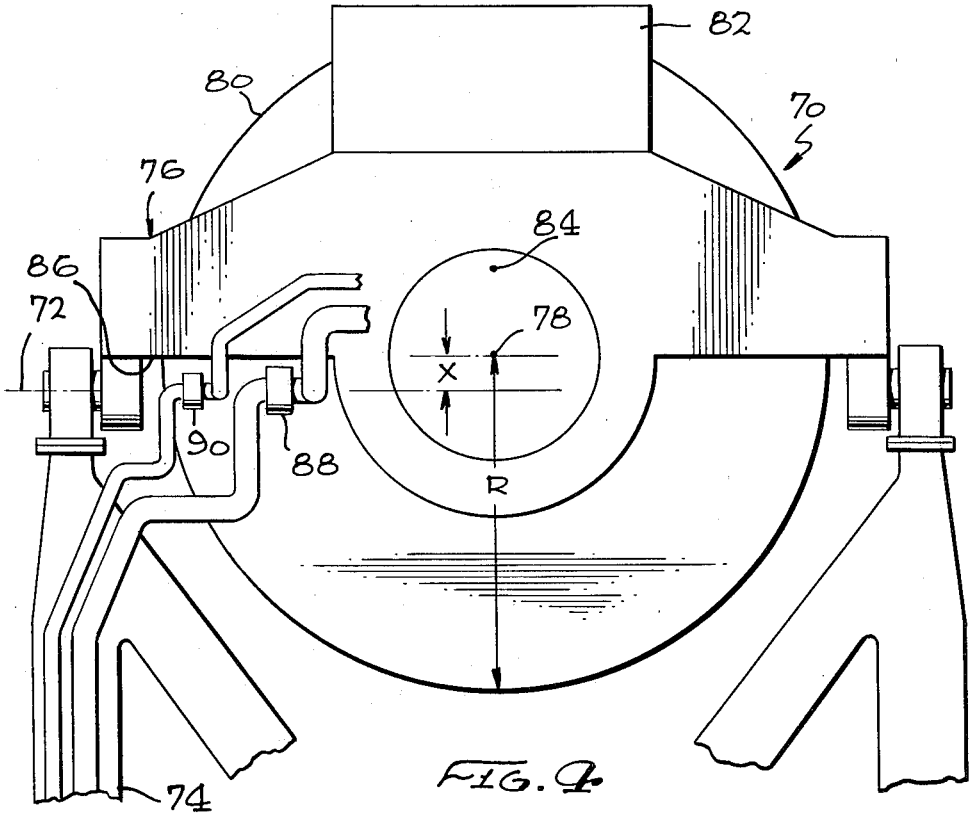
FIG. 4

BUOY-TO-YOKE COUPLING SYSTEM

BACKGROUND OF THE INVENTION

A dedicated vessel, such as one utilized to store and process hydrocarbons from an undersea well prior to delivery to a tanker, can be moored through a heavy duty yoke to a buoy that is anchored to the sea floor. A system of this type is described in U.S. Pat. No. 4,290,158, by Kuntz, wherein a crossarm rotatably mounted on top of the yoke has opposite ends pivotally connected about a horizontal axis to a yoke. Where fluid is to be transferred between the buoy and ship, much of the fluid conduit can be mounted on the yoke to protect it from waves. However, the fluid conduit must be constructed to accommodate pivotal motion of the yoke with respect to the buoy. One approach is to utilize a flexible hose, but such hoses are more expensive and less reliable than hard pipe conduits, particularly where the fluid is under high pressure. It is possible to utilize hard piping, with the piping and a fluid joint extending outside the confines of the yoke and through the bearings that connect the yoke to the cross arm. However, piping extending beyond the yoke is somewhat more vulnerable to damage, and results in additional complication of the heavy duty yoke-to-crossarm connection. A yoke-to-buoy connection which was relatively simple and yet which permitted the use of hard piping while minimizing exposure of the piping to damage, would be of considerable value.

SUMMARY OF THE INVENTION

In accordance with one embodiment of the present invention, a mooring and fluid transfer system is described, of the type wherein a yoke moors the ship to a buoy and a fluid conduit extends between the ship and buoy, which enables the use of a protected and simply-installed fluid swivel joint to accommodate pivoting motion between the yoke and buoy. The system includes a yoke coupling having a middle rotatably mounted about a vertical axis on top of the buoy body, and a pair of opposite ends pivotally connected to the yoke about a horizontal axis. The yoke coupling has a cutout, or empty space, between its middle and at least one end, and the fluid conduit includes a fluid swivel joint lying in that space and with its axis coincident with the horizontal axis of pivoting of the yoke coupling to the yoke.

The novel features of the invention are set forth with particularity in the appended claims. The invention will be best understood from the following description when read in conjunction with the accompanying drawings.

BRIEF DESCRIPTION OF THE DRAWINGS

FIG. 3 is a view taken on the line 3—3 of FIG. 2.

FIG. 4 is a partial plan view of a mooring and fluid transfer system constructed in accordance with another embodiment of the invention.

DESCRIPTION OF THE PREFERRED EMBODIMENTS

Figure 1:
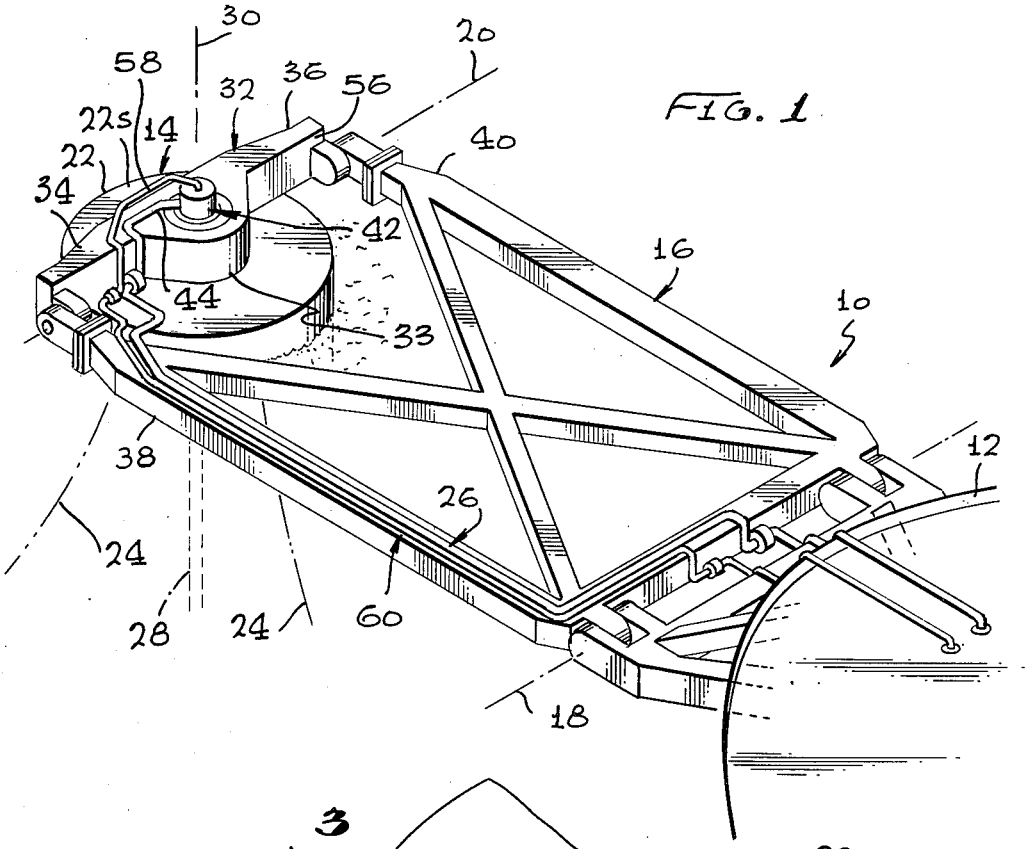
FIG. 1 is a perspective view of a mooring and fluid transfer system constructed in accordance with the present invention.

FIG. 1 illustrates a system 10 for mooring a ship 12 to a buoy assembly or buoy 14, and for transferring fluids between them. The system includes a heavy duty yoke

16 pivotally connected about a first horizontal axis 18 to the ship and about a second horizontal axis 20 to the buoy. The particular buoy assembly 14 is of the type which includes a buoyant body 22 floating at the sea surface and anchored against excessive drifting by catenary chains 24 extending to the sea floor. Hydrocarbons such as oil or gas may be delivered through the buoy and along the yoke to the ship by way of a conduit 26 which includes an underbuoy hose 28 extending up from the sea floor to the buoy, and along the yoke from the buoy to the ship. This type of system can be used to deliver hydrocarbons to a ship 12 which processes the hydrocarbons as by removing sand and by removing gas from oil, and which stores the hydrocarbons until a tanker can come alongside the ship 12 to remove them for transport.

While the buoyant body 22 of the body assembly cannot rotate about a vertical axis 30, rotation of the ship under the influence of changing winds, waves and currents is accommodated by use of a yoke connector or crossarm 32 which lies on top of the buoyant body 22 and which can rotate about the vertical axis 30. The middle portion 33 of the yoke connector is rotatably mounted by heavy duty bearings on the buoy body, while the arms 34, 36 of the yoke connector are each pivotally connected to a corresponding arm 38, 40 of the yoke. The fluid conduit 26 is also constructed to accommodate rotation of the ship about the vertical axis 30, by the use of a large fluid swivel or product distribution unit 42 which has a stationary portion mounted on the buoy body 22 and a rotatable part connected to a pipe section 44 supported on the yoke connector and that carries fluid towards the ship.

Figure 2:
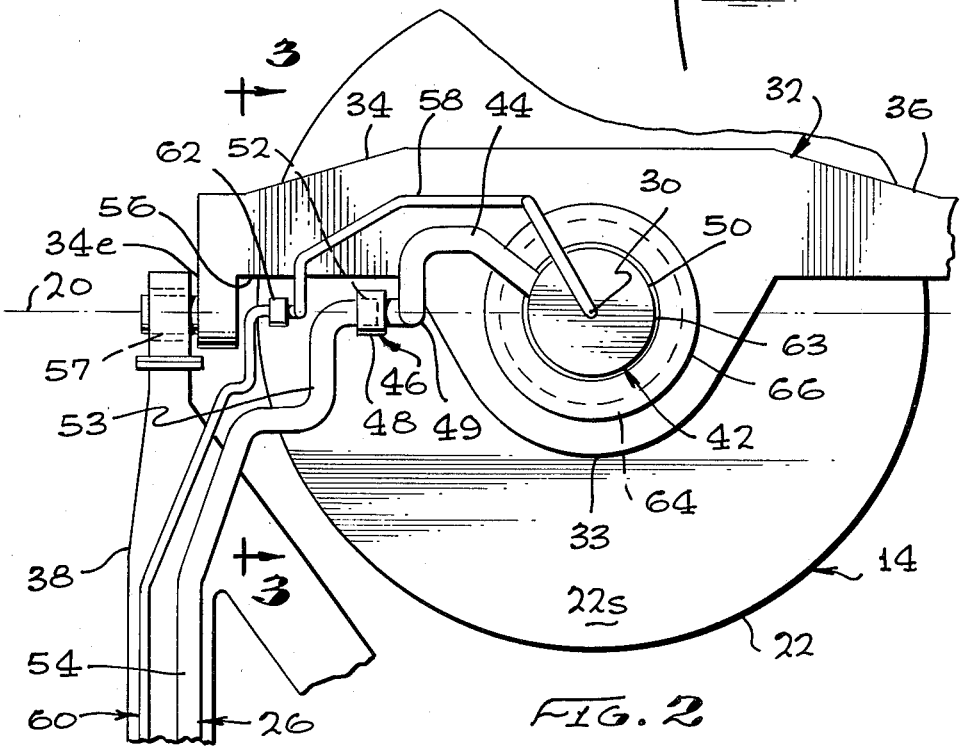
FIG. 2 is a partial plan view of the system of FIG. 1.

As shown in FIG. 2, the horizontal pivot axis 20 of each yoke arm such as 38 on each arm such as 34 of the yoke connector, is positioned so it extends through the vertical axis 30 of the buoy, in this particular embodiment of the invention. The fluid conduit 26 must also accommodate pivotal motion about this horizontal axis 20. This is accomplished by utilizing a fluid swivel joint 46 along the fluid conduit, with the axis of pivoting of the joint lying on the axis 20 of the yoke-to-crossarm connection. In particular, the joint 46 has one joint part 48 connected through a largely vertical pipe section 49 and through the pipe section 44 that leads to the rotatable part 50 of the main fluid swivel 42; the joint 46 also has another joint part 52 connected through an inclined pipe section 53 to a pipe section 54 that is supported on and extends along the yoke towards the ship.

In order to accommodate the fluid joint 46, the horizontal pivot axis 20 is located above the top of the buoyant body 22 of the buoy assembly. In addition, the yoke connector or crossarm 32 is constructed with a cutout 56 between its middle portion 33 and the extreme side or end 34*e* of an arm 34. The fluid joint 46 lies in this cutout to lie along the horizontal pivot axis 20, and with the fluid joint axis coincident with the axis 20.

It would be desirable to position the horizontal pivot axis 20 at a low level, below the top of the buoyant body 22 of the buoy assembly, to minimize tipping of the buoy body when it is pushed or pulled by the ship. In installations designed for use where severe weather conditions are encountered, lowering of the horizontal pivot axis is important, and can be accomplished by utilizing crossarm ends that extend a considerable distance downwardly below the top of the buoy body. In that case, the fluid conduit can be constructed to accommodate pivoting about the horizontal axis by passing the fluid conduit around the extreme outside of the yoke and through the bearings that connect the yoke to the crossarm. However, the need to pass the conduit through the yoke-to-crossarm bearings 57 considerably complicates the installation as well as making it more vulnerable to damage. Another technique is to utilize a flexible hose in the conduit between the yoke and crossarm to accommodate pivoting, but a flexible hose is much less reliable than hard piping, particularly where high pressures are encountered. The system of the present invention wherein the horizontal pivot axis 20 lies above the upper surface of the buoyant body 22 and wherein a cutout 56 is provided in the crossarm and the fluid joint 46 lies in the cutout, is especially useful where relatively mild weather conditions are encountered (so the high pivot axis 20 does not lead to excessive buoy tilt) and where high pressure fluids are encountered so hard piping is desirable.

Although the horizontal axis 20 of yoke-to-buoy connection lies above the upper surface 22S of the buoyant body, it is preferably located as low as possible to minimize tilting of the buoy by forces from the ship. As also shown in FIG. 3, the outer end **34*e* of the buoy connector arm 34 lies beyond the periphery of the buoy body 22 and extends slightly below the upper surface 22S thereof. The height of the horizontal axis 20 is just high enough to provide clearance between the fluid joint 46 and the upper surface 22S of the buoyant body. It may be noted that it would be possible to utilize a recess in the upper buoy body surface to receive the fluid joint 46** to further lower the horizontal axis, but the complications would generally not be worthwhile.

Most installations utilize more than one conduit, and a second conduit 60 is shown which extends parallel to the first conduit 26, and which has a separate fluid joint 62 (FIG. 2) coaxial with the horizontal axis 20. The pipe sections 44, 58 of the two conduits which extend from the fluid joints to the main fluid swivel 42, both are mounted on the crossarm 32 for support. It is noted that the rotatable part 50 of the main fluid swivel 42 is preferably rotatably mounted independently of the crossarm 32; the crossarm is mounted on bearings 64 about a heavy duty ring 66 on the buoy body so that forces are not transmitted through the swivel 42. This can be accomplished by providing a slight gap 63 between them. Only slight relative movement of the crossarm to the rotatable portion of the fluid swivel 50 is normally encountered, which can be accommodated by the pipes 44, 58 on the crossarm.

FIG. 4 illustrates a mooring and fluid transfer system 70 wherein the horizontal axis 72 about which the yoke 74 is connected to a crossarm or yoke connector 76, is horizontally displaced by a distance X from the vertical axis of rotation 78 of the connector on the buoyant body 80 of the buoy assembly. The buoy connector 76 is constructed with an overhanging portion 82, which locates the center of gravity of the buoy assembly at a location such as at the point 84 which is on a side of the vertical axis opposite the ship. By locating the horizontal pivot axis 72 on a side of the vertical axis opposite the center of gravity 84, the weight of the yoke on the buoy tends to compensate for the offcenter location of the center of gravity at 84 of the buoy assembly, to minimize tilting of the buoy assembly. It is noted that the horizontal axis 72 of connection of the yoke to the buoy connector, is still near the vertical axis 78; that is, the displacement X is less than one-half the radius R of the buoyant body. The buoy connector 70 is provided with a cutout 86 which is located to accommodate fluid joints 88, 90 along the displaced pivot axis 72.

Thus, the invention provides a mooring and fluid transfer system which is especially useful for transferring fluids under high pressure, in geographic areas where moderate to mild weather conditions are normally encountered, which facilitates the use of hard piping. This is accomplished by utilizing a yoke connector rotatably mounted on a buoyant body, which has a space between its middle portion that is rotatably mounted on the buoyant body and an end which connects to the yoke, and with a fluid joint located in the space with its pivot axis substantially aligned with the horizontal axis of pivoting the yoke on the yoke connector.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In a mooring and fluid transfer system for a ship wherein a yoke is used to moor the ship to the buoy body of a buoy assembly, and a conduit extends between the ship and buoy assembly to carry fluid, the improvement comprising:

a yoke connector having a middle rotatably mounted about a vertical axis on top of said buoy body and a pair of ends extending to opposite sides of said buoy body;

a yoke having a first yoke end pivotally coupled to opposite ends of said yoke connector about a first horizontal axis, and an opposite yoke end coupled to said ship;

a fluid swivel mounted at the top of said buoy body, and having a rotatable part that can rotate about said vertical axis; and a fluid conduit extending along said yoke between said ship and said buoy assembly and coupled to the rotatable part of said fluid swivel;

said yoke connector having a cutout lying along said first horizontal axis between the middle of the yoke connector and at least one of said ends of said yoke connector, for receiving said conduit; and said conduit including a fluid swivel joint having a swivel axis lying in said cutout with the swivel axis thereof lying on said first horizontal axis.

2. The improvement described in claim 1 wherein:

said conduit includes a first pipe section extending along and supported on said yoke, a second pipe section extending from said first section to one end of said fluid joint, a third pipe section extending along and supported on said yoke connector, and a fourth pipe section extending between an end of said fluid joint and said third pipe section.

3. The improvement described in claim 1 wherein:

said buoy body has an upper surface over which said fluid swivel joint lies; and said ends of said yoke connector have portions lying below the level of said upper surface of said buoy body, but with said first axis lying above said upper buoy body surface to pass through said fluid joint.

4. The improvement described in claim 1 wherein:

said first horizontal axis passes through said vertical axis.

5. The improvement described in claim 1 wherein:

said yoke connector has a center of gravity lying on a side of said vertical axis which is opposite said ship, and said first horizontal axis of yoke pivoting lies on a side of said vertical axis opposite said center of gravity by a fraction of the radius of said buoy body, whereby to use the yoke weight to help balance the buoy connector.

6. Apparatus for coupling a ship to the buoyant body of a buoy assembly, comprising:

a yoke connector rotatably mounted about a vertical axis on the top of said buoy body and having a pair of opposite sides lying at substantially opposite sides of said buoy body;

a yoke having a ship end pivotally connected about a first horizontal axis to said ship and having a buoy end pivotally connected about a second horizontal axis to said buoy assembly, said yoke having a pair of opposite yoke arms at its buoy end, each yoke arm connected to an opposite side of said yoke connector about said second horizontal aixs; and a fluid conduit extending between said ship and said buoy assembly, including a pipe section mounted on said yoke and a fluid swivel joint connected to said pipe section and having a pair of joint parts that can pivot relative to one another, said fluid joint located so its pivot axis is coincident with said second horizontal axis;

said yoke connector having a middle portion near said axis of rotation and having at least a first side connected to a yoke arm, which both lie on said second horizontal axis, and said connector is constructed to leave a space along said second horizontal axis between said middle portion and said first side of said connector, and said fluid joint is located in said space.

7. The apparatus described in claim 6 wherein:

said yoke connector has a center of gravity located on a side of said vertical axis which is opposite said ship, and said second horizontal axis is spaced from said vertical axis by less than one-half the buoy body radius and lies on a side of said vertical axis which is opposite said center of gravity.

* * * * *